United States Patent [19]

Peter et al.

[11] Patent Number: 4,567,869

[45] Date of Patent: Feb. 4, 1986

[54] METHOD AND APPARATUS FOR ADAPTING THE CHARACTERISTIC OF A FINAL CONTROLLING ELEMENT

[75] Inventors: Cornelius Peter; Claus Ruppmann, both of Stuttgart, Fed. Rep. of Germany

[73] Assignee: Robert Bosch GmbH, Stuttgart, Fed. Rep. of Germany

[21] Appl. No.: 650,812

[22] Filed: Sep. 14, 1984

[30] Foreign Application Priority Data

Sep. 21, 1983 [DE] Fed. Rep. of Germany ..... 3334062

[51] Int. Cl.[4] ..... F02D 41/16

[52] U.S. Cl. ..... 123/339; 123/350

[58] Field of Search ..... 123/339, 340, 350

[56] References Cited

U.S. PATENT DOCUMENTS 4,108,127 8/1978 Chapin et al. ..... 123/339

FOREIGN PATENT DOCUMENTS 2128779 5/1984 United Kingdom ..... 123/339

*Primary Examiner*—Andrew M. Dolinar

*Attorney, Agent, or Firm*—Walter Ottesen

[57] ABSTRACT

The invention is directed to a method and an apparatus for adapting the characteristic of a final controlling element to eliminate disturbances and other undesired influencing quantities and, particularly for adapting the controller characteristic for the idle air charge control of internal combustion engines. A desired air quantity value issued by a regulator on the basis of various operating conditions is corrected by multiplicative and/or additive action prior to being delivered to an idle control element, for example, by means of which a change is effected in the cross-sectional area of the opening of a bypass valve arranged in the fuel metering arrangement of the internal combustion engine. This correction relates to adapting a characteristic of the idle control element with respect to offset and slope. This is accomplished by evaluating the output signals of at least one offset integrator or one slope integrator to generate an adapted electrical actuating quantity for the idle control element. The integrators are released in dependence on operating conditions and receive an input differential signal obtained from the signal indicative of the desired air quantity value from the regulator and a signal indicative of the actual air quantity.

11 Claims, 3 Drawing Figures

METHOD AND APPARATUS FOR ADAPTING THE CHARACTERISTIC OF A FINAL CONTROLLING ELEMENT

BACKGROUND OF THE INVENTION

In many fields of engineering, it is conventional practice to determine certain quantities, values or positions by means of closed or open loop control. This is accomplished by utilizing a regulator to deliver a quantity, usually electrical, indicative of a specific function course to some final controlling element; the regulator processes specific input signals from the controlled system and also includes in its control action the result obtained by the adjustment of the final controlling element. If, in the overall configuration of an open or closed loop control, disturbances or other undesired influencing quantities result which are exclusively attributable to the action of the final controlling element, in other words, the characteristic of the final controlling element does not follow exclusively the desired value supplied to it, then substantial deviations from the set values may occur which may give rise to overshoot depending on the time constants occurring, or the control may be too slow.

While being generally suitable for the adaptation of the characteristic of any kind of final controlling element, the invention will be explained in the following with reference to a preferred embodiment, applied to the action of the final controlling element in the idle air charge controller for an internal combustion engine, since this is a preferred field of application for the invention.

Thus, it is known to regulate the idle speed of an internal combustion engine such that an idle speed regulator receives specific data on the instantaneous operating condition of the internal combustion engine including, for example, intake manifold pressure, instantaneous speed, desired idling speed and other peripheral operating data such as throttle position, the position of a bypass valve on which the idle air charge controller especially acts, and/or data on the quantity of intake air or air mass in lieu of the intake manifold pressure.

The idle speed regulator is in a position to determine from these quantities an electrical correcting quantity as a desired value, for example, a signal $\dot{Q}_{des}$ indicative of the desired air quantity or a signal $\dot{m}_{des}$ indicative of the desired air mass and feed this signal to an idle control element which converts, for example, the air mass desired value into a cross-sectional area of aperture (of the bypass valve referred to above).

It is particularly in the idle air charge controller for an internal combustion engine that allowance has to be made for special conditions such as minimum possible fuel consumption and the keeping constant of a minimum idle speed even on abrupt load changes. Accordingly, idle speed regulators are known (German published patent application DE-OS No. 3,039,435) which are configured to compensate for deviations from a desired speed and to hold such deviations to a low value. However, a problem to be realized in this connection is that speed variations ultimately reflect reactions of the internal combustion engine to external influences and that corresponding speed signals constitute the last link in the control chain, so that necessarily a certain amount of time will elapse between an action on the internal combustion engine and its ensuing reaction thereto. Therefore, in internal combustion engines running at extremely low rpm while idling, there exists at least the danger of an uneven running condition occurring and finally the possibility of a stalled engine if loads with high power requirements such as air conditioners and the like are switched in rapidly.

This problem is even increased by the action of the idle control element itself since the control element characteristic shows a considerable dependency upon the relevant temperature and the operating voltage supplied by the internal combustion engine which likewise may be subject to major variations. Conventionally, idle control elements operate as electromagnetic converters with respect to the adjustment of the cross-sectional area of the aperture through which the internal combustion engine receives the required quantity of air, in which case they may be configured as single-winding controllers or as a magnet part in the actuation of a valve.

With the idle control element cold, the winding of the control element will take up a larger amount of current at a given pulse duty factor; the result is a larger deflection and a corresponding mismatch. Similar negative effects result when the battery voltage varies substantially as is frequently the case in internal combustion engines. Therefore, in order to minimize the mismatch in the control element range, the idle control element requires a complex configuration and a highly consistent characteristic in order to properly convert the electrical actuating quantity supplied to its input into the cross-sectional area of the opening.

However, even with an idle control element reacting as perfectly as possible, unavoidable dependencies remain, such as leakage air flowing past the throttle valve in the idle position, a dependence on altitude of the cross-sectional area of the aperture provided by the idle control element and the like.

SUMMARY OF THE INVENTION

It is, therefore, one of the objects of the invention to provide an apparatus for adapting the characteristic of a final controlling element which satisfies the condition that the desired quantity delivered to the final controlling element is substantially equal to the actual quantity obtained from the action of the final controlling element with the inclusion of marginal influences, applied to the idle control element with respect to an idle control element characteristic, that is, that the desired air quantity or air mass quantity at the output of the idle speed regulator is substantially equal to the air quantity or air mass supplied to, or drawn in by, the internal combustion engine.

The method and apparatus of the invention afford the advantage that the adaptation of the characteristic of the final controlling element (which may vary under certain influencing quantities) as well as the inclusion and consequently also the leveling of other disturbances are performed so as to result in an effective independence of the control element characteristic, thereby obviating the need for an especially complex configuration of the particular final controlling element utilized which, when applied to idle air charge control, is the idle control element. The invention permits the use of a simpler controller configuration, whereby complete independence is obtained of the altitude at which the internal combustion engine is at a given time when the air mass is measured and the dependence on altitude is drastically reduced where air quantity is measured.

Further, the invention ensures an independence of leakage air, thus dispensing with the need for engine adjustments; in addition, the adaptation of the invention which proceeds throughout the entire control operation ensures that the actual idle air charge control is not influenced.

Further advantages of the invention will become apparent from the subsequent description of the preferred embodiments of the invention.

BRIEF DESCRIPTION OF THE DRAWING

The invention will now be described with reference to the drawing wherein.

DESCRIPTION OF THE PREFERRED EMBODIMENTS OF THE INVENTION

The following description is directed to an embodiment of the invention wherein the idle air charge control arrangement for an internal combustion engine (spark ignition engine), is optimized so that the desired air quantity value $\dot{Q}_{des}$ provided by an idle speed regulator is converted into an actual quantity $\dot{Q}_{act}$ via an adaptation of a control element characteristic and the idle control element, where $\dot{Q}_{des}$ is to be approximately equal to $\dot{Q}_{act}$.

According to a basic idea of the invention, the adaptation to the instantaneous characteristic of the idle control element and to the leakage air proceeds according to a specific strategy whose objective it is to act additively and/or multiplicatively on the desired quantity delivered by the idle speed regulator.

Figure 1:
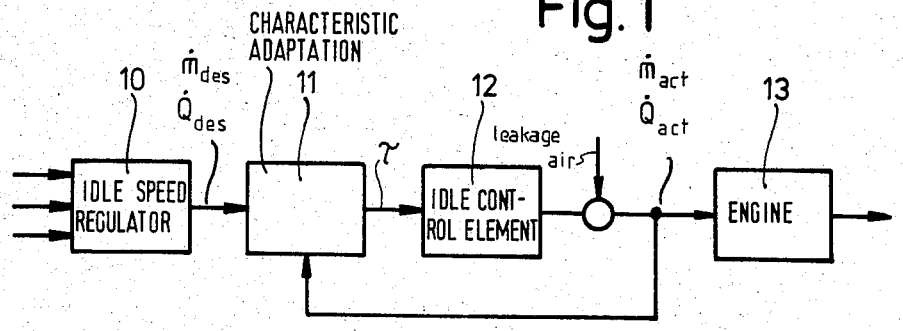
FIG. 1 is a block diagram depicting an idle air charge control arrangement with an idle speed regulator, an idle control element controlled by the regulator, and a characteristic adaptation circuit connected therebetween pursuant to an embodiment of the invention.

Referring now to FIG. 1, reference numeral 10 identifies an idle speed regulator, and reference numeral 12 identifies a final controlling element in the form of an idle control element which is controlled by the regulator via the apparatus 11 for characteristic adaptation. In this embodiment, the idle control element 12 acts on the cross-sectional opening in the intake conduit of an internal combustion engine 13, particularly, by causing a suitable increase or reduction in the cross-sectional area of a bypass valve or also by a motor-driven displacement of the throttle valve.

In this arrangement, the air which the internal combustion engine 13 ultimately receives is composed of the air which the control element 12 allows to pass on the basis of the signals it receives, and a remainder of leakage air flowing, for example, through the throttle valve. As a result of the characteristic adaptation of the invention which takes place in block 11, the air quantity $\dot{Q}_{des}$ or desired air mass value $\dot{m}_{des}$ provided by the idle speed regulator 10 is converted into an electrical actuating quantity $\tau$ in such a manner that the idle control element 12 adjusts the air quantity (or air mass) to a value which, together with the leakage air, yields the desired intake air quantity $\dot{Q}_{act}$ (or air mass $\dot{m}_{act}$).

In order to perform the characteristic adaptation, two integrators are provided, that is I1 for the characteristic offset and I2 for the characteristic slope; these integrators operate only if, as a result of specific operating conditions, the intervention effected thereby on the characteristic adaptation can be released. Therefore, the integrators are connected to release members, with offset integrator I1 being assigned release member FG1 and slope integrator I2 being assigned release member FG2.

Accordingly, slope integrator I2 acts on the desired quantity issued by idle speed regulator 10 multiplicatively via a multiplier M using a predetermined factor; whereas, the offset correction from the output of integrator I1 is performed additively at a summing point S1.

Both integrators I1 and I2 receive an air quantity differential signal $\Delta\dot{Q}$ from a second summing point or reference point S2. The signal $\Delta\dot{Q}$ corresponds to the deviation of the desired quantity (desired air quantity value $\dot{Q}_{des}$ or desired air mass value $\dot{m}_{des}$) from the actual quantity (air quantity $\dot{Q}_{act}$ or air mass $\dot{m}_{act}$). Actual air quantity $\dot{Q}_{act}$ may be derived from an air flow sensor provided in the intake conduit or it may be obtained in some other manner known per se.

Therefore, the desired relationship $\dot{Q}_{act}=\dot{Q}_{des}$ (it is understood that reference can also be made to the air mass and will no longer be referred to in the following) can be obtained by changing two parameters, that is, by varying the offset K1 and the slope K2. In order to ensure specific initial values of the characteristic, the outputs of integrators I1 and I2 are connected to summing points S3 and S4, respectively, which receive initial values K10 and K20 for the offset and the slope, respectively.

It is essential that the adaptation applied to the instantaneous characteristic of the idle control element and the leakage air proceed according to the strategy described below.

Integrator I1 for the offset of the characteristic operates only if the throttle valve remains closed for a time exceeding a predetermined time $T1=f(n)$ and if the engine speed n is within a specific range, that is, the idle range. Accordingly, release member FG1 for the integrator I1 is configured so that it receives a throttle valve signal DK and the actual value of the engine speed n; and only if the above-mentioned two conditions are satisfied, will the offset integrator I1 be released for operation.

Regarding the action of integrator I2 which causes a variation of the slope of the characteristic by multiplication and thus has a considerably stronger impact on the electrical correcting quantity $\tau$ serving as an input signal for the idle control element, it is to be noted that this integrator will only be released if the throttle valve remains closed for a predetermined time T2 which may be 100 ms, for example. The time relationship for T2 is as follows:

$$T2<t<T1=f(n)$$

by means of which it is possible to eliminate overshoot and corresponding errors introduced by the air flow sensor. Another condition to be met is that $Q_{des}$ is greater than the last value of $Q_{des}$ prior to opening of the throttle valve. This means that the instantaneous adaptation operating point for integrator I2 on the characteristic has to lie above the adaptation operating point reached by the action of offset integrator I1.

Figure 3:
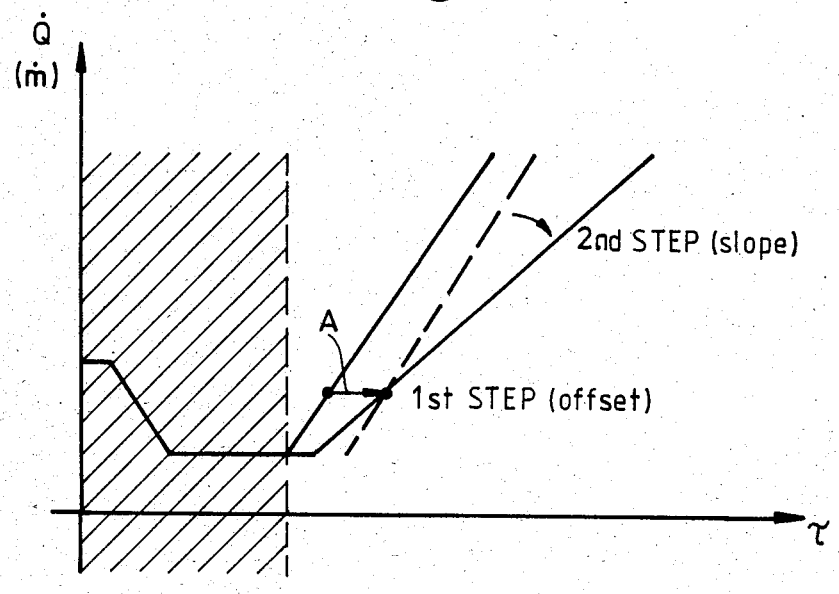

Referring to the characteristic shape of FIG. 3, the shaded bend of the characteristic in the left part of the drawing is merely shown for the sake of completeness and is for an idle control element. This characteristic remains unaffected in its capacity as a characteristic for emergency operation by the arrangement of the invention. Looking at the characteristic, it will be seen that the first adaptation step is the shift of the operating point as a result of offset as indicated by arrow A; the multiplicative action on the slope must not occur at an operating point which lies below the offset operating point because this would cause the reverse and undesired effect to be obtained. The slope adaptation always takes place at operating points above the offset operating point.

Accordingly, the conditions on which release block FG2 releases slope integrator I2 are set up such that the slope adaptation takes place only when the air flow rate is greater than, for example, a minimum rate as is clearly the case under idling conditions.

Figure 2:
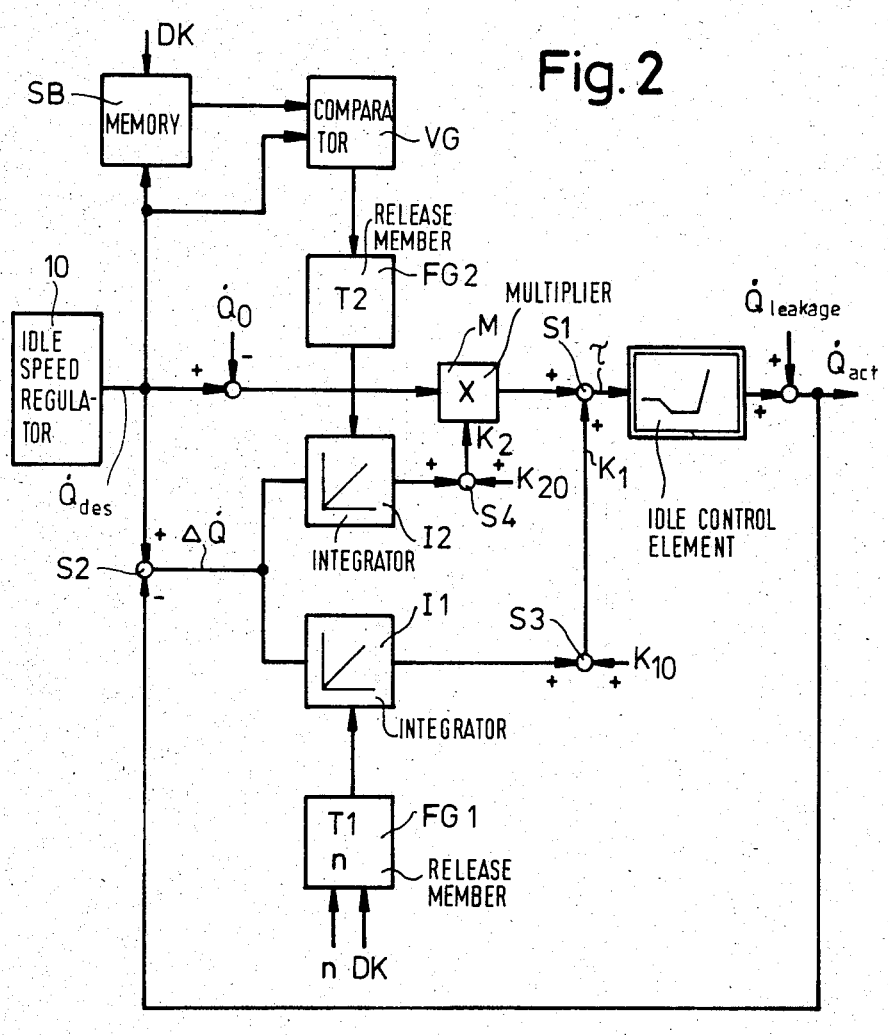
FIG. 2 is a block diagram depicting the apparatus for characteristic adaptation; and, FIG. 3 is a diagram of the control element characteristic of air quantity or air mass plotted against the electrical correcting quantity $\tau$, and shows the effects of the adaptation of the invention on the shape of the characteristic.

To meet these conditions, the preferred procedure is to put the instantaneous values of $\dot{Q}_{des}$ or $\dot{m}_{des}$ in a memory store the moment the throttle valve opens; for this purpose, a memory block SB is provided which receives a throttle valve signal DK and the value $\dot{Q}_{des}$; this storage corresponds to the last operating point at which an adaptation has been performed by the offset integrator I1. To release the slope adaptation, a check is then made to determine if the instantaneous air quantity required ($\dot{Q}_{des}$; $\dot{m}_{des}$) is greater than the value last stored; only if this is the case will a release ensue; the block comparing the two desired values is identified by VG in FIG. 2.

Alternatively, this condition may be replaced by the consideration that a slope adaptation can be released whenever the instantaneous speed is above a specific speed, that is, if for example the condition $n > n_{LL} + 500$ $min^{-1}$ is fulfilled, because it can be assumed that a higher engine speed also results in an operating point on the characteristic which lies above the idle point so that the proper characteristic segment is involved. Such an increased speed is the case, for example, after a fully opened throttle or in overrun operation. It is to be noted, however, that this consideration should only apply as an alternative and that the storage of the desired values prior to throttle opening has absolute preference.

Another circumstance has to be mentioned. Multiplier M is preceded by another summing point S4 at which an air quantity $\dot{Q}_0$ is subtracted from desired quantity $\dot{Q}_{des}$. This arrangement serves to optimize the operating range. The value of $\dot{Q}_0$ should not exceed the minimum desired air quantity value $\dot{Q}_{des}$ occurring so that the quantity arriving after summing point S4 at the input of multiplier M is preferably always greater than zero. Adding such a negative value of $\dot{Q}_0$ permits the turning point of the curve or characteristic to be as close to the operating point as possible. Assuming an ideal case which is, however, undesirable and in which the $\dot{Q}_0$ value supplied coincides exactly with the operating point, it is possible to adapt and represent the curve using but one iteration step, that is, one offset adjustment and one slope adjustment. However, even if the turning point lies lower as a result of the deviation of the value of $\dot{Q}_0$ from the direct operating point, the total number of iteration steps required is still smaller.

It is understood that the foregoing description is that of the preferred embodiments of the invention and that various changes and modifications may be made thereto without departing from the spirit and scope of the invention as defined in the appended claims.

What is claimed is:

1. Method of adapting a characteristic of a final controlling element to eliminate disturbances and other undesired quantities acting thereon, the method being applicable to apparatus such as an internal combustion engine having an idle air charge control arrangement equipped with an idle control element, the method being especially for adapting the characteristic of said idle control element, the arrangement controlling the quantity of air delivered to the engine during the idle mode of operation and including an idle speed regulator for supplying a desired value $Q_{des}$ of air quantity and said idle control element, the method comprising the steps of:

transforming the desired output value ($\dot{Q}_{des}$, $\dot{m}_{des}$) of the idle speed regulator supplied to the idle control element into an adapted electrical control quantity ($\tau$) for said idle control element by means of regulation that takes into account an actual value output ($\dot{Q}_{act}$, $\dot{m}_{act}$) which at least partially depends upon the instantaneous actual position of the idle control element; and, said transformation including the step of arithmetically combining said desired output value with the output of at least one of two integrators influencing the offset and the slope, respectively, of the characteristic of said idle control element.

2. The method of claim 1, comprising the step of releasing each of said integrators to influence said electrical control quantity ($\tau$) for said idle control element in dependence upon varying quantities indicative of operating conditions of the internal combustion engine.

3. The method of claim 2, wherein said integrators for offset and slope adaptation having respective time constants that are so large that the action on the characteristic adaptation is therefore so slow that the actual air charge control is not influenced.

4. The method of claim 2, said integrator for influencing offset and additively correcting said electrical control quantity ($\tau$) being released only when a throttle valve of the internal combustion engine has been closed for a predetermined length of time dependent upon the speed of the engine [T1=f(n)] and said speed is in the idle range.

5. The method of claim 4, said integrator for influencing slope being released only if the throttle valve is closed for a predetermined period of time [T2<Tn] by not longer closed than an additional predetermined period of time, and if the operating point at which a slope adaptation takes place is above the operating point reached by an offset adaptation.

6. The method of claim 5, comprising the step of comparing a value $\dot{Q}_{des}$ stored at the instant of the last opening of the throttle valve corresponding to the last operating point whereat an adaptation by offset adjustment was performed with a required desired value $\dot{Q}_{des}$; and, then releasing said integrator for slope adaptation when the slope-adapted operating point lies always above the offset adapted operating point.

7. The method of claim 6, comprising the step of subtracting a constant air quantity $\dot{Q}_o$, which is equal to or greater than the minimal value of the desired value of air quantity, from the desired value of air quantity $\dot{Q}_{des}$ provided by said idle speed regulator thereby reducing the iteration steps for offset and slope adaptation.

8. Apparatus for adapting a characteristic of a final controlling element to eliminate disturbances and other undesired quantities acting thereon, the apparatus being especially for adapting the idle control element characteristic in the idle air charge control arrangement of an internal combustion engine, the arrangement controlling the quantity of air delivered, to the engine during the idle mode of operation and including an idle speed regulator for supplying a desired value $\dot{Q}_{des}$ of air quantity and said arrangement further including said idle control element, the apparatus for adapting the characteristic of the idle control element comprising:

a first integrator for providing a first output for additively influencing said desired value for offset adapting the characteristic of said idle control element;

a second integrator for providing a second output for multiplicatively influencing said desired value for slope adapting the characteristic of said idle control element; and, release means for releasing at least one of said integrators for influencing said desired value.

9. The apparatus of claim 8 comprising:

air flow sensor means for detecting the actual value $\dot{Q}_{act}$ of the quantity of air flowing to the engine;

a first summing point connected to the output of said first integrator for supplying an initial offset value for said characteristic thereto;

a second summing point connected to the output of said second integrator for supplying an initial slope value for said characteristic thereto;

a third summing point connected to said idle speed regulator and said air flow sensor for forming the difference value $\Delta Q$ between said desired value $\dot{Q}_{des}$ and said actual value $\dot{Q}_{act}$;

the inputs of said integrators being connected in parallel and to said third summing point for receiving said difference value $\Delta Q$;

multiplier means connected to the output of said second summing point; and, a fourth summing point connected to the output of said first summing point, said fourth summing point being further connected in series between said multiplier means and said idle control element so as to cause said desired quantity $\dot{Q}_{des}$ of said idle speed regulator to be additively and multiplicatively transformed into an actual value $\dot{Q}_{act}$ of the air quantity via a controller characteristic adaptation and said idle controller.

10. The apparatus of claim 9, said release means comprising:

a first release block connected to said first integrator for acting thereon to release said first output thereof in dependence upon predetermined operating conditions of the engine; and, a second release block connected to said second integrator for acting thereon to release said second output thereof in dependence upon predetermined operating conditions of the engine.

11. The apparatus of claim 10, comprising a fifth summing point serially connected between said idle speed regulator and said multiplier for adding a negative basic value $\dot{Q}_o$ of air quantity whereby said basic value $\dot{Q}_o$ is equal to or greater than the minimal value of said desired value $\dot{Q}_{des}$.

* * * * *

UNITED STATES PATENT AND TRADEMARK OFFICE

CERTIFICATE OF CORRECTION

PATENT NO. : 4,567,869

DATED : February 4, 1986

INVENTOR(S) : Cornelius Peter and Claus Ruppmann

It is certified that error appears in the above-identified patent and that said Letters Patent is hereby corrected as shown below:

In column 6, line 15: delete "$Q_{des}$" and substitute -- $\dot{Q}_{des}$ -- therefor.

In column 6, line 50: delete "by" and substitute -- but -- therefor.

In column 6, line 51: delete "closed".

In column 6, line 52: delete "time," and substitute -- time T1 = f(n) , -- therefor.

In column 6, line 50, "/T2<Tn/" should read -- [T2<T1] --.

Signed and Sealed this

*Twelfth* Day of *August 1986*

[SEAL]

*Attest:*

*Attesting Officer*

DONALD J. QUIGG

*Commissioner of Patents and Trademarks*